US010377156B2

(12) United States Patent
Ikemoto et al.

(10) Patent No.: US 10,377,156 B2
(45) Date of Patent: Aug. 13, 2019

(54) PRINTING APPARATUS

(71) Applicant: Brother Kogyo Kabushiki Kaisha, Nagoya, Aichi (JP)

(72) Inventors: Yusuke Ikemoto, Nagoya (JP); Ryuichi Kanda, Nagoya (JP); Takehiko Inaba, Chita-gun (JP); Yuki Nagashima, Toyokawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/940,130

(22) Filed: Mar. 29, 2018

(65) Prior Publication Data

US 2018/0297380 A1 Oct. 18, 2018

(30) Foreign Application Priority Data

Apr. 13, 2017 (JP) ..... 2017-079451

(51) Int. Cl.

| | |
|---|---|
| ***B41J 15/04*** | (2006.01) |
| ***B41J 3/407*** | (2006.01) |
| ***B41J 3/36*** | (2006.01) |
| ***B65H 16/06*** | (2006.01) |
| *B41J 11/70* | (2006.01) |

(52) U.S. Cl.

CPC ..... *B41J 15/04* (2013.01); *B41J 3/36* (2013.01); *B41J 15/042* (2013.01); *B65H 16/06* (2013.01); *B41J 3/4075* (2013.01); *B41J 11/703* (2013.01); *B65H 2403/411* (2013.01); *B65H 2511/12* (2013.01); *B65H 2801/12* (2013.01)

(58) Field of Classification Search

CPC ..... B41J 15/04; B41J 15/042; B41J 3/4075; B41J 3/36; B65H 16/06

See application file for complete search history.

(56) References Cited

U.S. PATENT DOCUMENTS

2006/0216098 A1* 9/2006 Lyman ..... B41J 3/4075 400/613
2015/0225198 A1* 8/2015 Sakaino ..... B41J 11/0025 242/566

FOREIGN PATENT DOCUMENTS

| | | | |
|---|---|---|---|
| JP | 2009-173353 | A | 8/2009 |
| JP | 2013-154580 | A | 8/2013 |
| JP | 2015-208978 | A | 11/2015 |
| JP | 2016-068433 | A | 5/2016 |

* cited by examiner

*Primary Examiner* — Kristal Feggins
*Assistant Examiner* — Kendrick X Liu
(74) *Attorney, Agent, or Firm* — Banner & Witcoff, Ltd.

(57) ABSTRACT

A printing apparatus, having a body with a container compartment, a cover, a pair of supporting parts, a locking member, and an engaging portion, is provided. The pair of supporting parts support the roll along a first direction. At least one of the pair of supporting parts is movable in the first direction. The locking member is arranged on the movable supporting part and is movable between a locked position and an unlocked position. The engaging portion in the container compartment is engageable with the locking member being located at the locked position. The locking member at the unlocked position under the condition where the cover is open is separated from the engaging portion. The locking member contacts the cover and shifts from the unlocked position to the locked position to be engaged with the engaging portion in a process where the cover being open is moved to be closed.

9 Claims, 13 Drawing Sheets

PRINTING APPARATUS

CROSS REFERENCE TO RELATED APPLICATION

This application claims priority from Japanese Patent Application No. 2017-079451, filed on Apr. 13, 2017, the entire subject matter of which is incorporated herein by reference.

BACKGROUND

Technical Field

An aspect of the present disclosure is related to a printing apparatus.

Related Art

A printing apparatus configured to store a roll of printing medium and print an image on the printing medium while the printing medium is unrolled and conveyed, is known. The printing apparatus may have, for example, a skew regulating device, which may restrain the printing medium from moving in a widthwise direction being orthogonal to a conveying direction so that the printing medium may be restrained from being conveyed obliquely. The skew regulating device may have two (2) guide fences and a lever. The guide fences may stand on widthwise sides of the unrolled printing medium to restrain the printing medium from moving in the widthwise direction. The guide fences may slidably move in the widthwise direction to fit to a width of the printing medium. The lever to switch movability of the guide fences may be arranged on a widthwise outer side of one of the guide fences, and a user may operate the lever to switch the guide fences to be movable or immovable.

SUMMARY

The lever to switch the movability of the guide fences to fit to the width of the roll of printing medium may be operated manually by the user. Therefore, the user may find it bothersome, or may forget, to operate the lever each time when a roll of printing medium in the printing apparatus is replaced with another roll of printing medium having a different width.

The present disclosure is advantageous in that a printing apparatus having a supporting part to support a roll of printing medium at widthwise sides, in which modes of the supporting part may be switched easily between a movable mode and immovable mode, is provided.

According to an aspect of the present disclosure, a printing apparatus, including a body, a cover, a pair of supporting parts, and a locking member, is provided. The body includes a container compartment to store a roll, which includes a rolled printing medium. The container compartment has an opening at one side along an orthogonal direction being orthogonal to a first direction. The first direction is a widthwise direction of the roll. The cover is closable to cover the opening of the container compartment and openable to uncover the opening of the container compartment. The pair of supporting parts are arranged in the container compartment and support one side and the other side of the roll along the first direction. At least one of the pair of supporting parts is movable in the first direction. The locking member is arranged on a movable supporting part being one of the pair of supporting parts that is movable in the first direction. The locking member is movable between a locked position, in which the locking member restricts the movable supporting part from moving under a condition where the cover is closed, and an unlocked position, in which the locking member allows the movable supporting part to move under a condition where the cover is open. The engaging portion is arranged in the container compartment and is configured to engage with the locking member being located at the locked position. The locking member at the unlocked position under the condition where the cover is open is separated from the engaging portion. The locking member is configured to contact the cover and shift from the unlocked position to the locked position to be engaged with the engaging portion in a process where the cover being open is moved to be closed.

BRIEF DESCRIPTION OF THE ACCOMPANYING DRAWINGS

Figure 4:
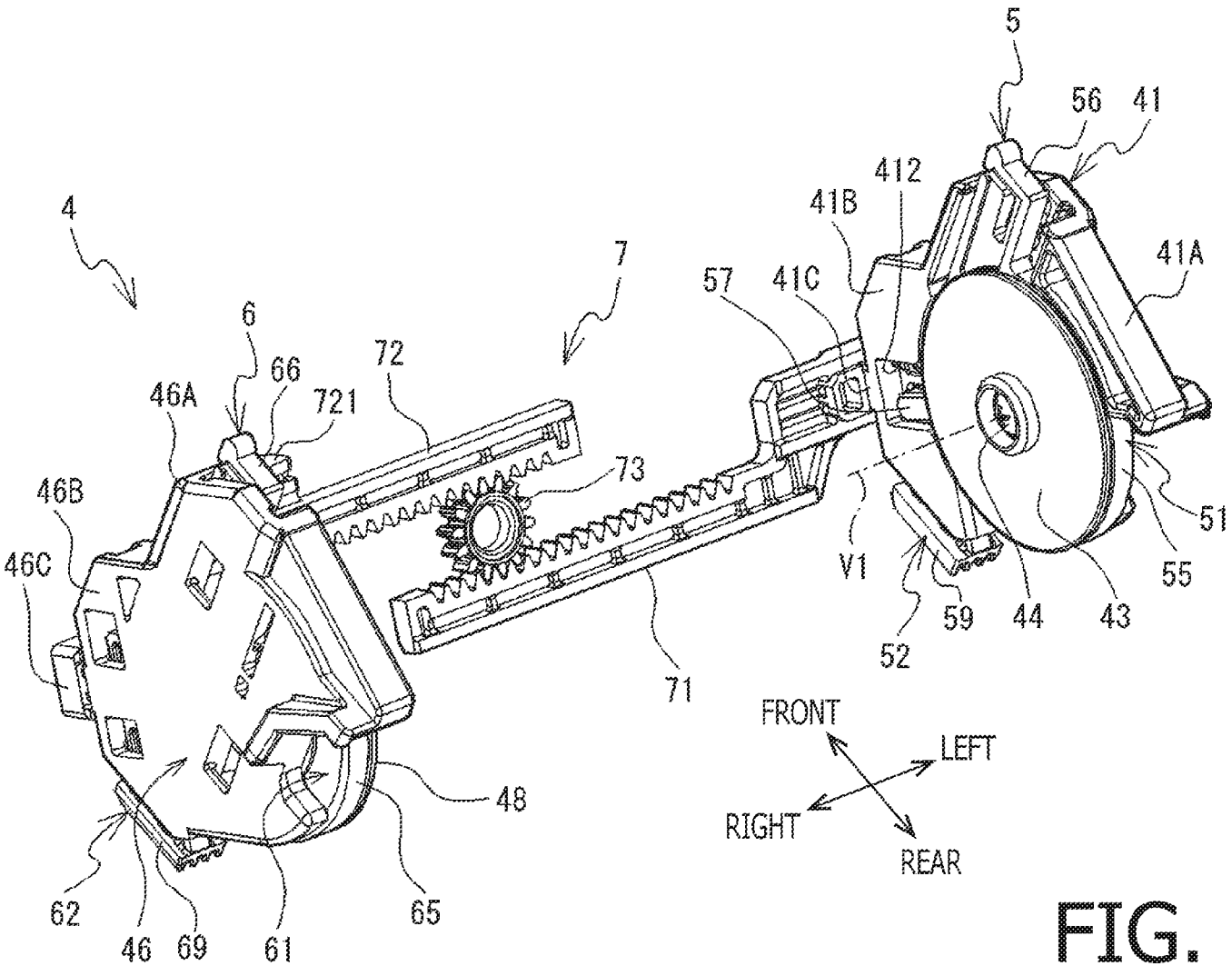

FIG. 4 is a perspective view of a pair of supporting parts 4, locking members 5, 6, and an adjustor 7 for the printing apparatus according to the first embodiment of the present disclosure.

Figure 5:
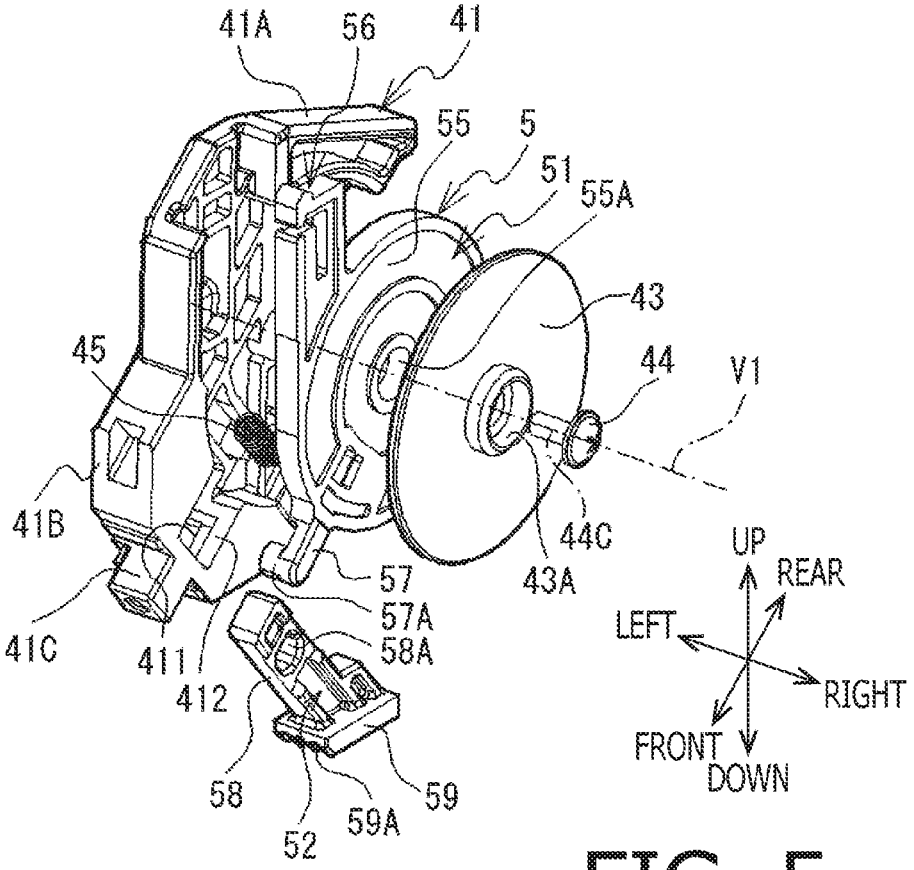

FIG. 5 is a perspective view of a supporting part 41, the locking member 5, and a rotary disk 43 for the printing apparatus 1 according to the first embodiment of the present disclosure.

Figure 6:
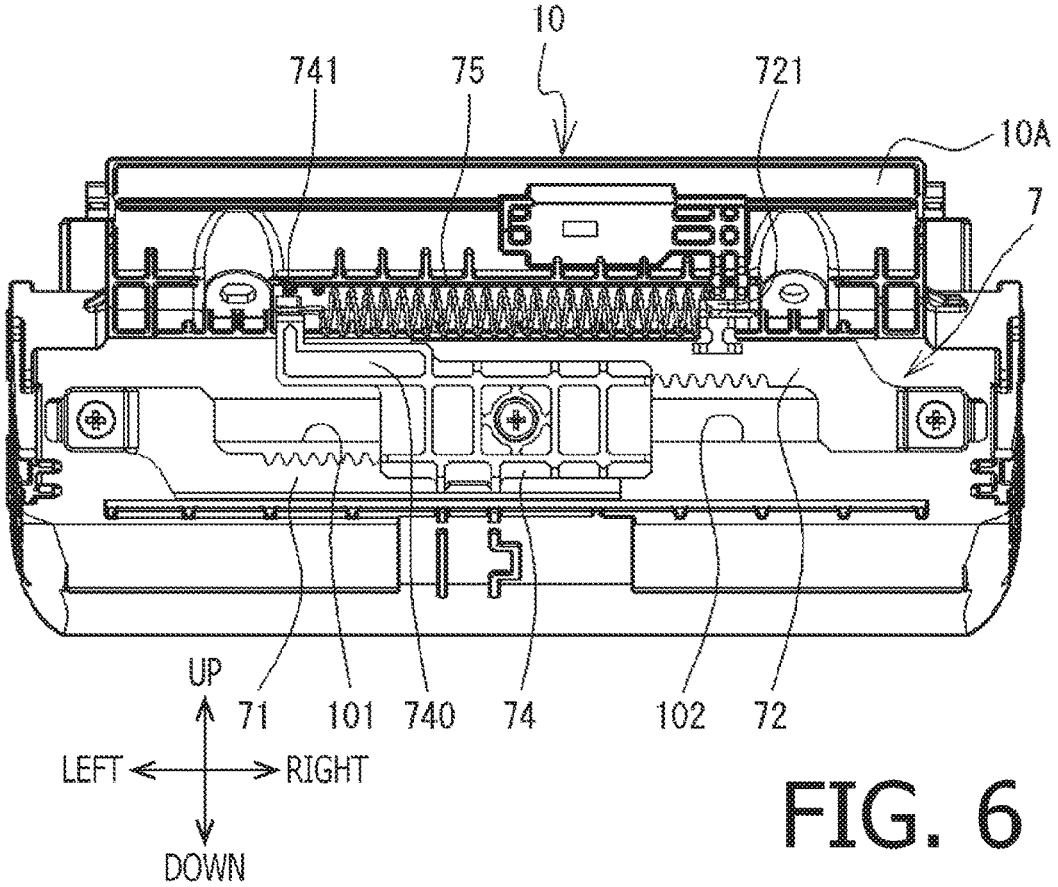

FIG. 6 is a frontward view of the adjuster 7 for the printing apparatus 1 according to the first embodiment of the present disclosure.

Figure 7:
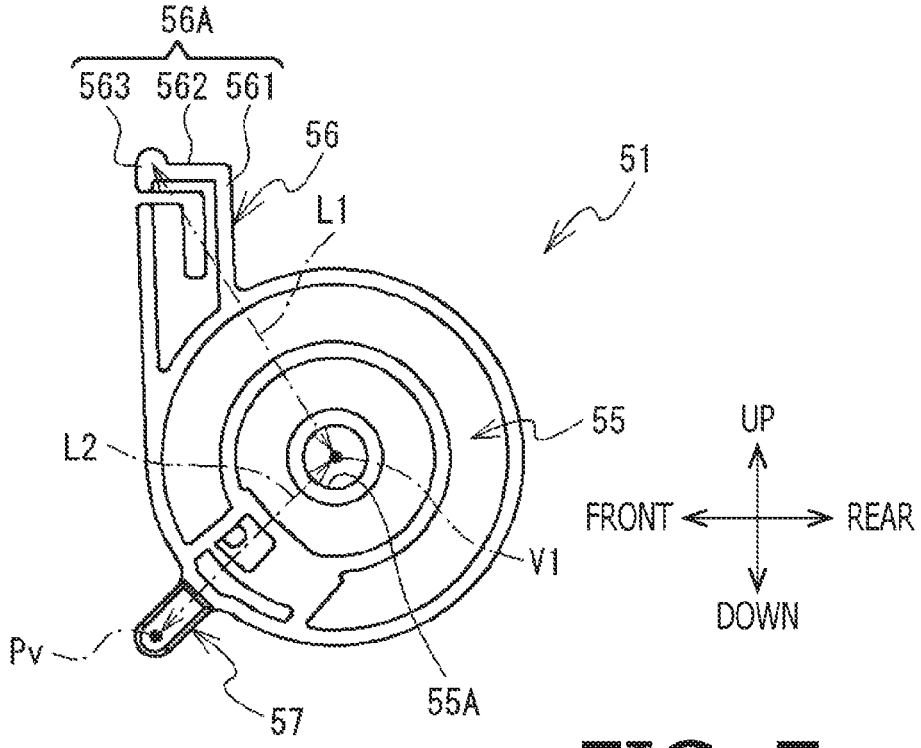

FIG. 7 is a sideward view of a first locking member 51 for the printing apparatus 1 according to the first embodiment of the present disclosure.

Figure 8:
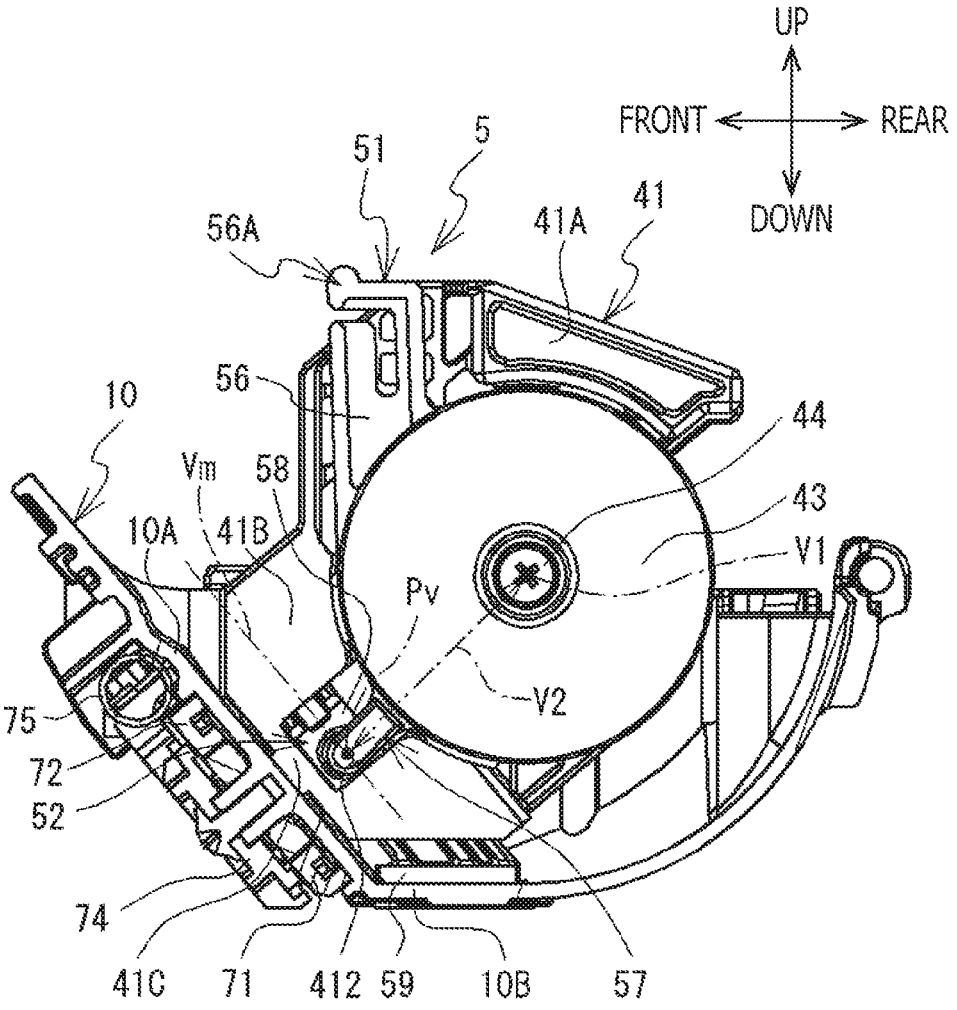

FIG. 8 is a sideward view of the supporting part 41, the locking member 5, and the rotary disk 43 for the printing apparatus 1 according to the first embodiment of the present disclosure.

Figure 9A:
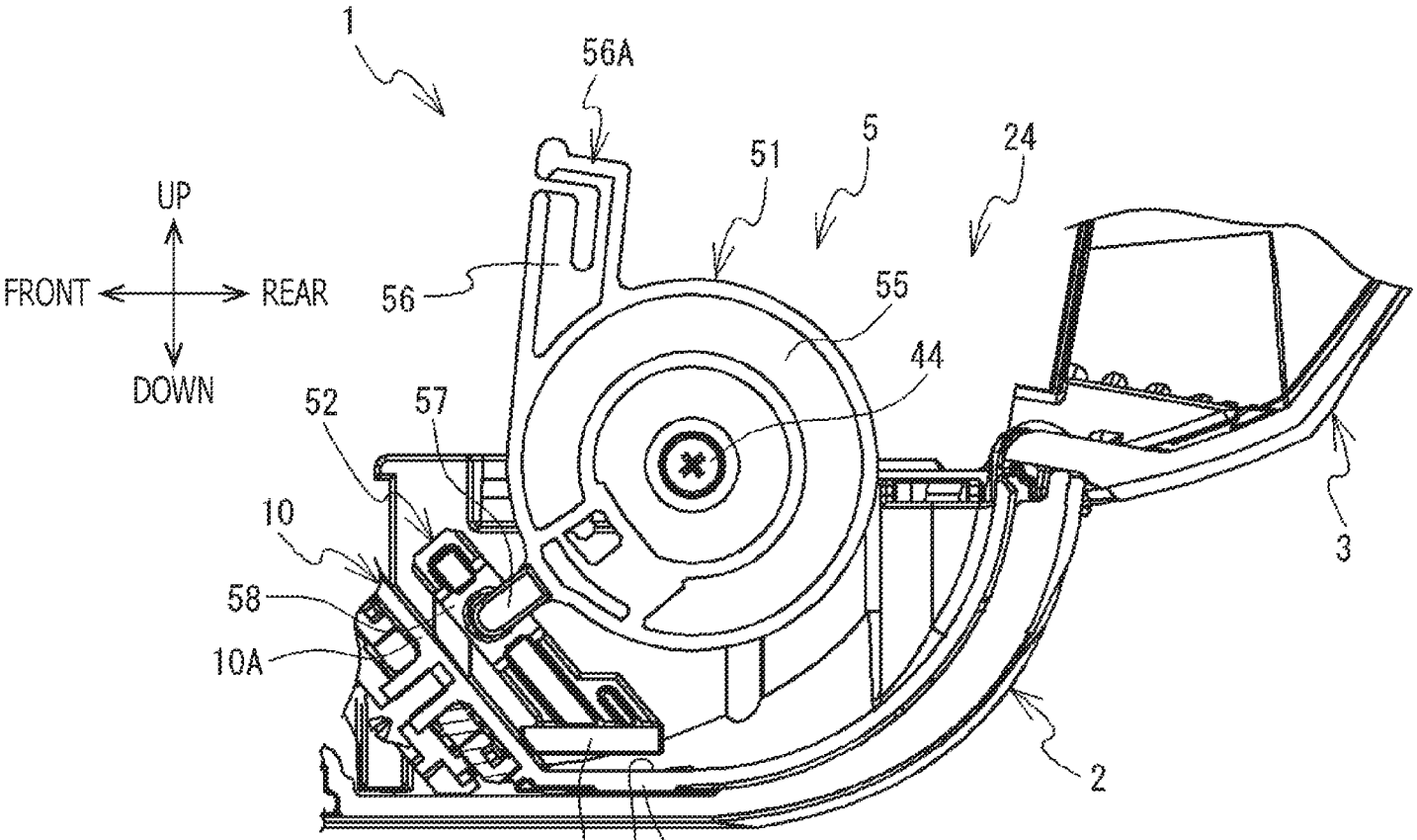
Figure 9B:
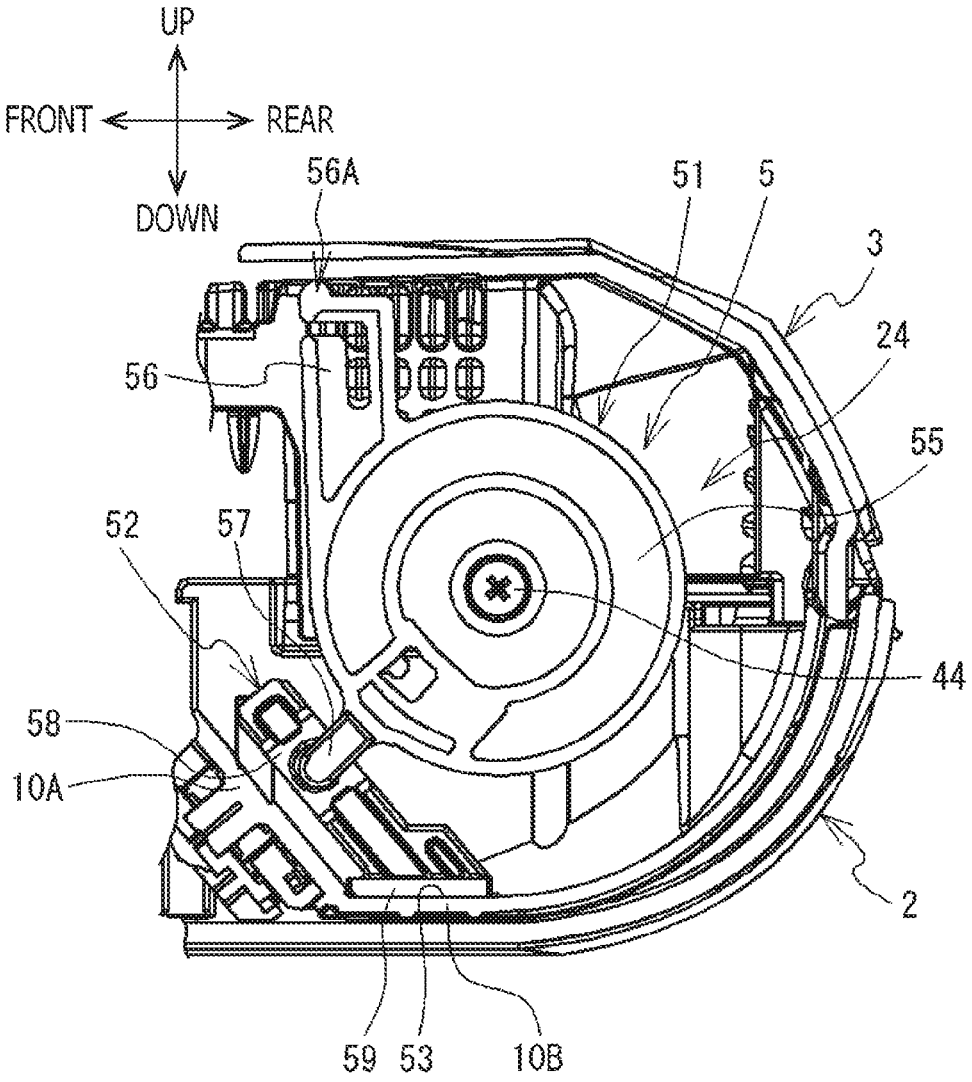

FIGS. 9A and 9B are cross-sectional views of the locking member 5 for the printing apparatus 1 when the cover 3 is at an open position and a closed position, respectively, according to the first embodiment of the present disclosure.

Figure 10:
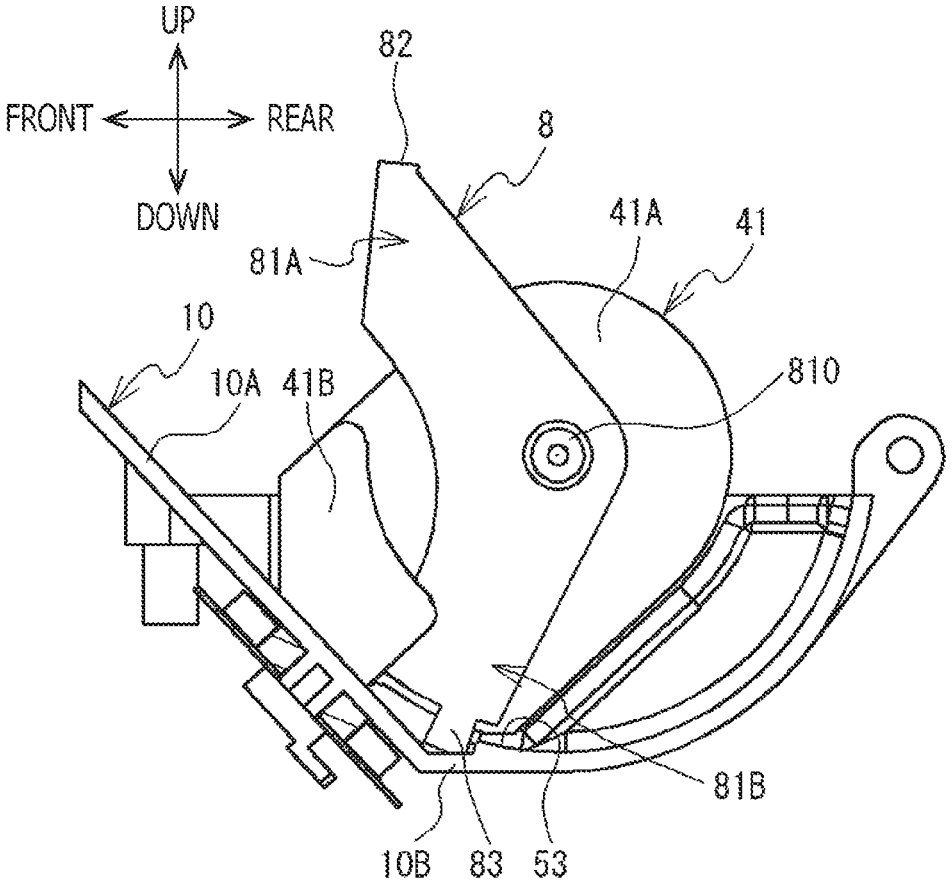

FIG. 10 is a rightward side view of the locking member 5 for the printing apparatus 1 according to a second embodiment of the present disclosure.

Figure 11A:
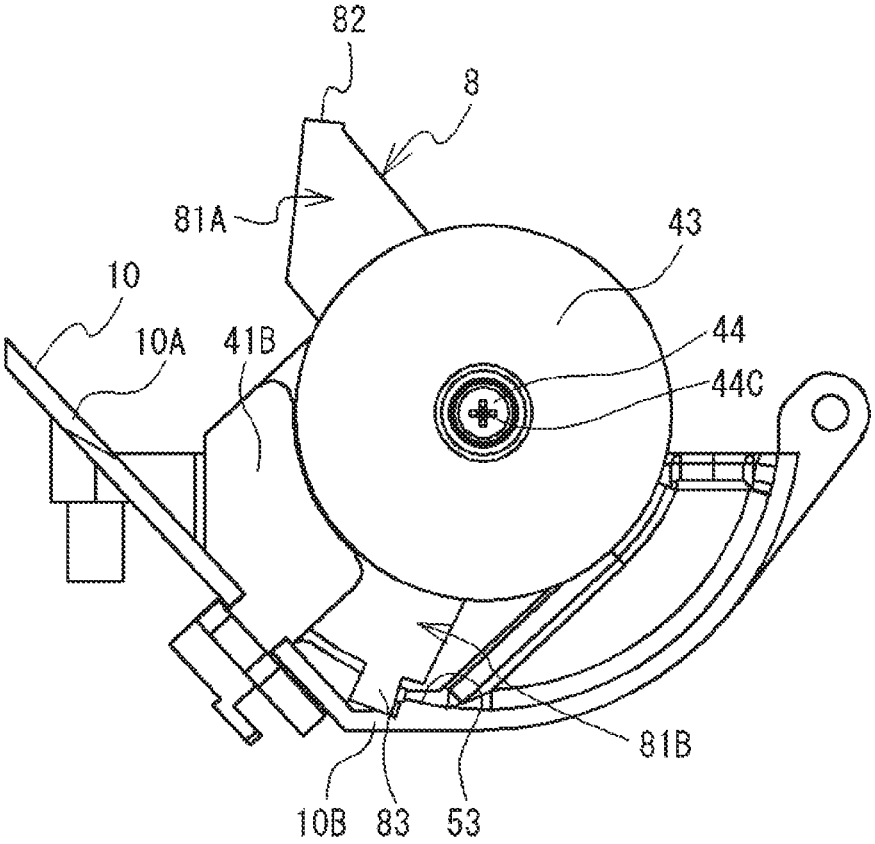
Figure 11B:
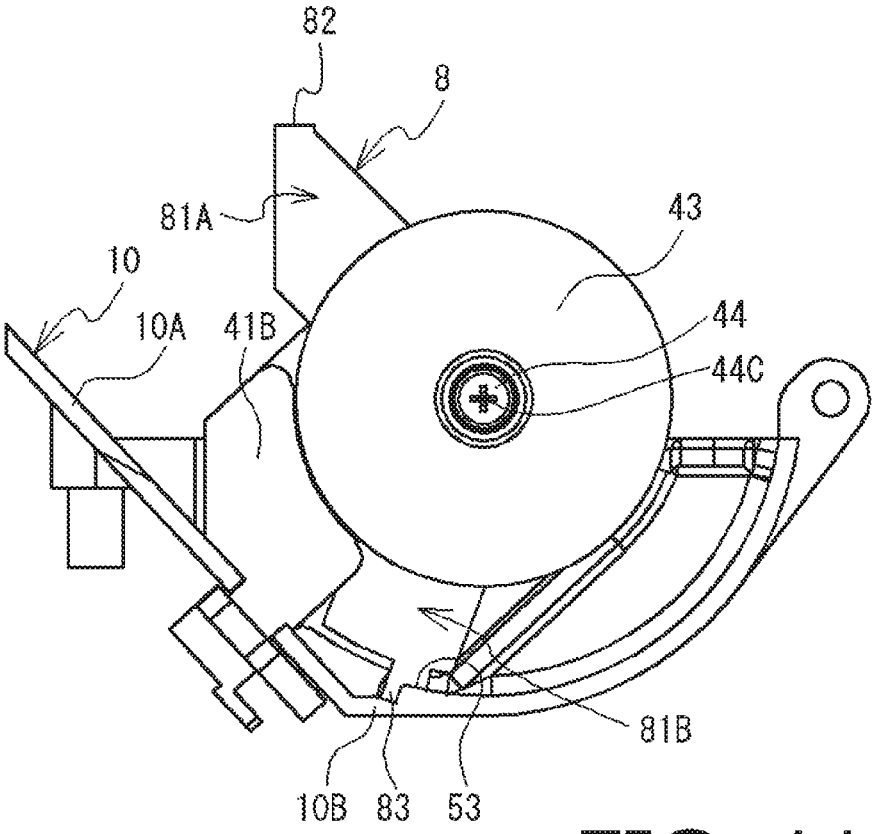

FIGS. 11A and 11B are cross-sectional views of the locking member 8 for the printing apparatus 1 when the cover 3 is at an open position and a closed position, respectively, according to the second embodiment of the present disclosure.

DETAILED DESCRIPTION

Hereinafter, embodiments of the present disclosure will be described with reference to the accompanying drawings.

First Embodiment

A printing apparatus 1 is connectable with an external terminal (not shown) through a USB (registered trademark)

cable. The printing apparatus 1 may print images, including characters such as text and figures, on a printing medium, which may be a thermosensitive tape. The external terminal may be a personal computer (PC). The printing apparatus 1 may be driven by a battery. The printing apparatus 1 may have a belt-attachable clip (not shown), by which the printing apparatus 1 may be attached to a belt on a user and carried by the user.

In the following description, directions related the printing apparatus 1 and each part or item included in the printing apparatus 1 will be mentioned on basis of indications by arrows in each drawing. For example, in FIG. 1, a viewer's a lower-rightward side, an upper-leftward side, an upper-rightward side, a lower-leftward side, an upper side, and a lower side will be referred to as a rightward side, a leftward side, a rearward side, a frontward side, an upper side, and a lower side, respectively, for the printing apparatus 1. A front-to-rear or a rear-to-front direction may be referred to as a front-rear direction, a left-to-right or right-to-left direction may be referred to as a widthwise direction, and an up-to-down or down-to-up direction may be referred to as a vertical direction.

<Body 2 and Cover 3>

Figure 1:
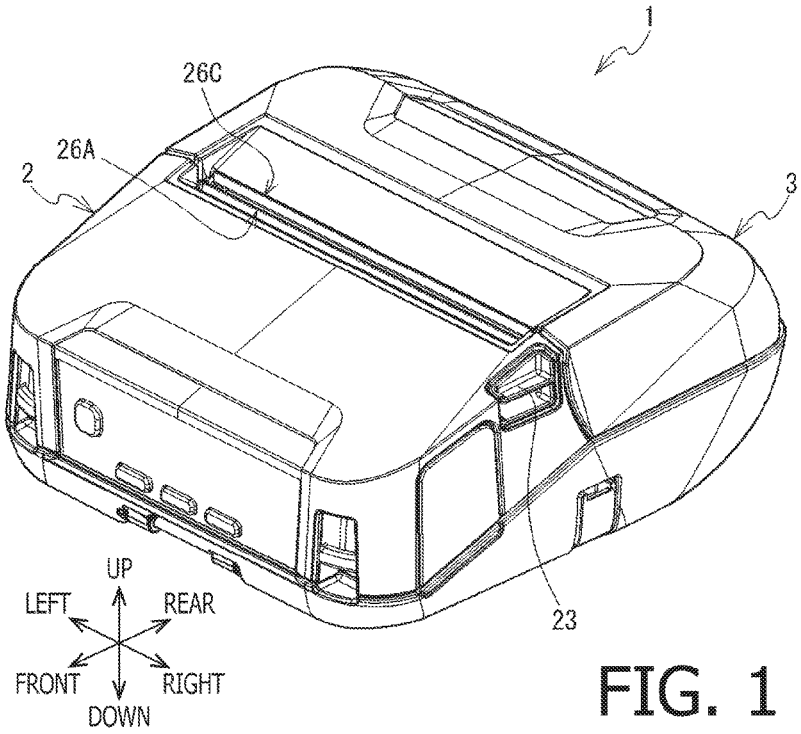
FIG. 1 is a perspective view of a printing apparatus 1, with a cover 3 being closed, according to a first embodiment of the present disclosure.
Figure 2:
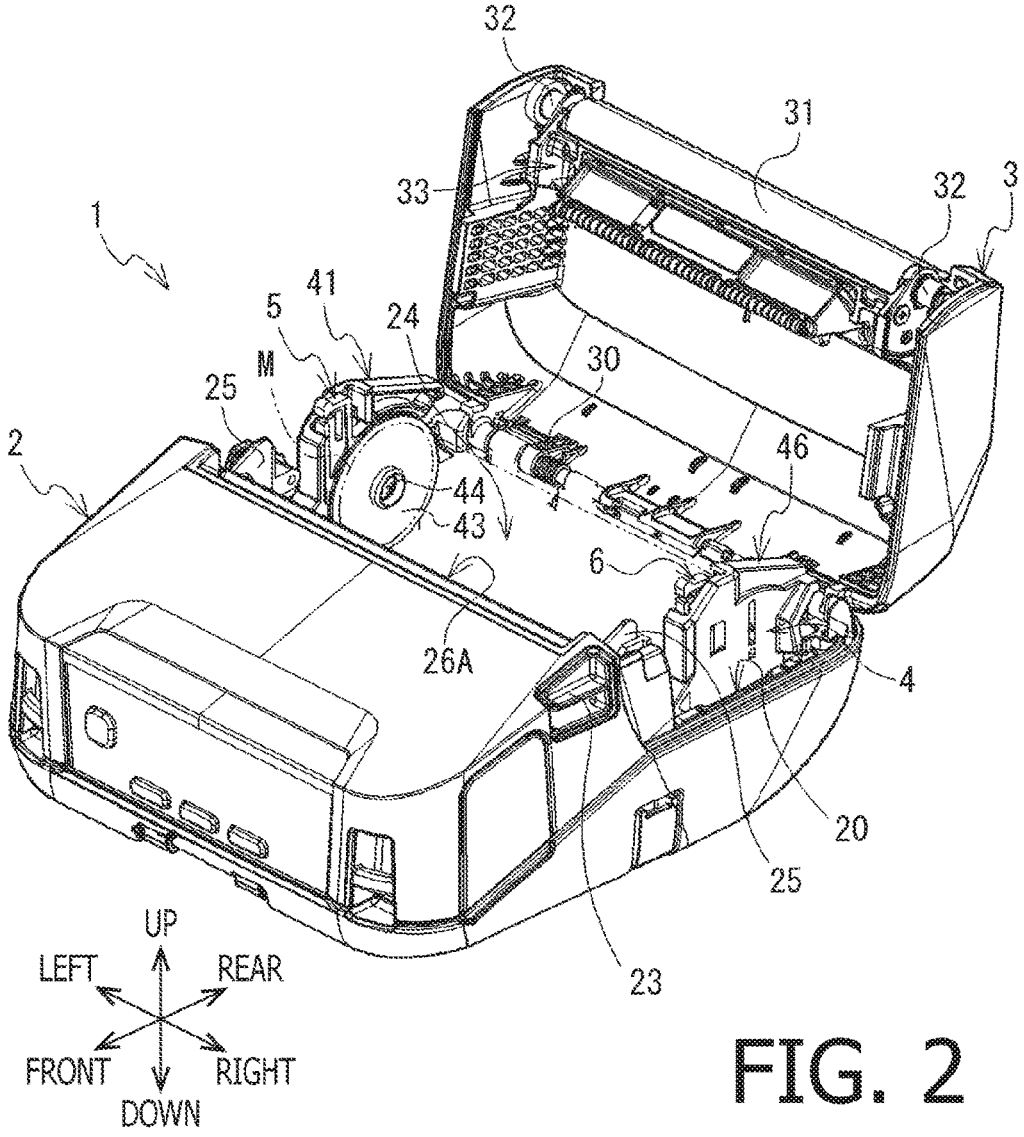
FIG. 2 is a perspective view of the printing apparatus 1, with the cover 3 being open, according to the first embodiment of the present disclosure.

As shown in FIG. 1, the printing apparatus 1 includes a body 2 and a cover 3. The body 2 may have an approximate shape of a six-sided box. As shown in FIG. 2, the body 2 has a container compartment 24 in a rearward half area inside. The container compartment 24 is defined by a partition (not shown), which divides the body 2 into a frontward half area and the rearward half area, widthwise end parts, a rearward end part, and a bottom part of the body 2. The container compartment 24 may be exposed open through an opening portion 20, which is formed in the body 2. The container compartment 24 may therein store a roll M, which may include a tubular core and an adhesive tape with a thermosensitive label rolled around the core.

Figure 3:
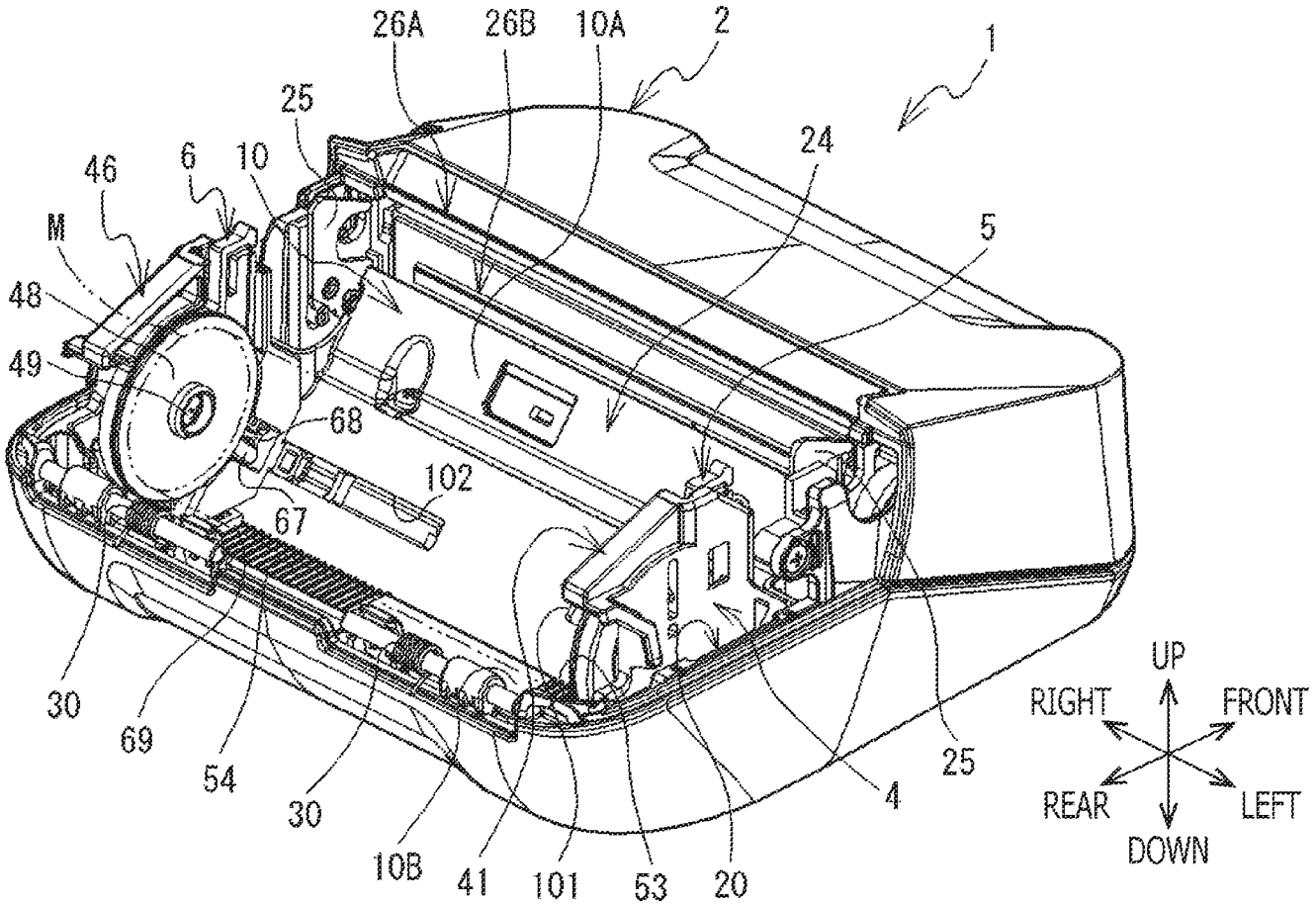
FIG. 3 is a perspective view of a container compartment 24 in the printing apparatus 1 according to the first embodiment of the present disclosure.

As shown in FIG. 3, at a frontward position in the opening portion 20 in the body 2, arranged is a cutter 26A. The cutter 26A may cut a part of the tape with an image printed thereon off from the roll M. At a lower position with respect to the cutter 26A, arranged is a thermal head 26B, which may print characters by heat on the thermosensitive label. The cutter 26A and the thermal head 26B extend longitudinally in the widthwise direction. Inside the body 2, at each widthwise end position in the opening portion 20, arranged is an engaging portion 25. The engaging portions 25 are swingably supported at lower ends thereof by the body 2. When a user pushes a lever 23 (see FIG. 1), which is arranged on a leftward side of the body 2, downward, upper ends of the engaging portions 25 may swing rearward.

As shown in FIGS. 1-2, the cover 3 is swingably supported at lower end thereof by a rearward end part of the body 2. The cover 3 may swing about the lower end thereof between a closed position (see FIG. 1) and an open position (see FIG. 2). As shown in FIG. 1, the cover 3 may cover the container compartment 24, which is below the opening portion 20, from above when the cover 3 is in the closed position and may uncover the container compartment 24 open when the cover 3 is in the open position. The cover 3 is urged by an urging member 30 (see FIGS. 2-3) in a direction from the closed position toward the open position, e.g., upward. In the following description, positions and directions related to the cover 3 comply with those of the printing apparatus 1 under a condition, where the cover 3 is at the closed position (see FIG. 3).

As shown in FIG. 2, a platen holder 33 to support a platen roller 31 rotatably is arranged at a frontward area in the cover 3. The platen roller 31 is rotatable about a rotation shaft, which extends in the widthwise direction. A bearing 32 in a tubular shape is arranged at each widthwise end of the rotation shaft of the platen roller 31 to extend outward in the widthwise direction. The engaging portions 25 on the right and the left may, when the cover 3 is in the closed position, catch the bearings 32 on the right and the left to hold, respectively, so that the cover 3 may be maintained at the closed position (see FIG. 1). When the cover 3 is in the closed position, and when the lever 23 (see FIG. 1) is pushed downward, the engaging portions 25 may release the bearings 32 so that the cover 3 may swing upward by the urging force of the urging member 30 from the closed position to the open position (see FIG. 2).

As shown in FIG. 1, when the cover 3 is in the closed position, the platen roller 31 (see FIG. 2) is placed to be closer to the thermal head 26B (see FIG. 3) than in the open position. The platen roller 31 may, when the tape is located between the platen roller 31 and the thermal head 26B, press the tape against the thermal head 26B. The platen roller 31 may be rotated by a motor (not shown) to press the tape against the thermal head 26B and convey the tape simultaneously. An outlet 26C is formed at a position between the cutter 26A and the platen roller 31 when the cover 3 is in the closed position so that the tape with the image printed thereon in the printing apparatus 1 may be ejected through the outlet 26C.

<Holder 10>

A holder 10 (see FIG. 3) is fixed to the container compartment 24. The holder 10 may rotatably hold the roll M, which may be set in such an orientation that a width thereof aligns with the widthwise direction. The holder 10 includes fixed parts 10A, 10B; a pair of supporting parts 4, which include supporting parts 41, 46; locking members 5, 6; rotary disks 43 (see FIG. 2), 48; and an adjustor 7 (see FIG. 4).

The fixed parts 10A, 10B are each in a shape of a plate. The fixed part 10A is fixed to a partition board (not shown), which forms a frontward wall of the container compartment 24. The fixed part 10A spreads along the partition board and inclines with respect to a horizontal direction to be higher toward the front and lower toward the rear. The fixed part 10A includes grooves 101, 102 (see FIG. 6), which extend linearly on a same line along the widthwise direction but are spaced apart from each other in the widthwise direction. The groove 102 is arranged on a rightward side with respect to the groove 101.

The fixed part 10B is connected to a rearward and lower end of the fixed part 10A. The fixed part 10B extends horizontally along a bottom of the body 2. The fixed part 10B includes engaging portions 53, 54. Each engaging portion 53, 54 has a plurality of teeth, which align with the widthwise direction and extend longitudinally in the front-rear direction. The engaging portions 53, 54 are arranged linearly on a same line along the widthwise direction and are spaced apart from each other along the widthwise direction. The engaging portion 54 is arranged on a rightward side with respect to the engaging portion 53.

<Paired Supporting Parts 4>

As shown in FIG. 3, the pair of supporting parts 4 are arranged on a rearward side with respect to the fixed part 10A. The supporting parts 4 includes the supporting part 41, which is arranged on the left, and the supporting part 46, which is arranged on the right. As shown in FIGS. 2 and 3, the supporting part 41 and the supporting part 46 face each other along the widthwise direction to support a leftward side and a rightward side of the roll M, respectively. The supporting parts 41, 46 are symmetrical. In the following paragraphs, the supporting part 41 may be described in detail while description of the supporting part 46 may be omitted.

As shown in FIG. 5, the supporting part 41 includes a base portion 41A, an extended portion 41B, and a protrusive portion 41C. The base portion 41A includes a portion having a shape of a plate that spreads orthogonally to the widthwise direction. The extended portion 41B extends lower-frontward from a position lower than a vertical center of a frontward end of the base portion 41A. The extended portion 41B has holes 411, 412, in which parts of the locking member 5 may be inserted. In particular, a protrusive portion 57 in a first locking member 51 and a base portion 58 in the second locking member 52 of the locking member 5 may be inserted in the holes 411, 412, respectively. The configuration of the locking member 5 will be described later more in detail. The hole 411 is formed to be open at a lower end of the extended portion 41B and bored obliquely upper-frontward in a lower part of the extended portion 41B. The hole 412 is formed to be open at a rightward end of the extended portion 41B and bored leftward. The hole 412 and the hole 411 communicate inside the extended portion 41B.

The protrusive portion 41C protrudes obliquely lower-frontward from a lower-frontward end of the extended portion 41B. The protrusive portion 41C is inserted in the groove 101 (see FIG. 6) formed in the fixed part 10A from the rear side to protrude frontward with respect to the fixed part 10A.

As shown in FIG. 4, the supporting part 46 includes a base portion 46A, an extended portion 46B, and a protrusive portion 46C, which are in configurations corresponding to the base portion 41A, the extended portion 41B, and the protrusive portion 41C, respectively, in the supporting part 41. The protrusive portion 46C is inserted in the groove 102 (see FIG. 6) formed in the fixed part 10A from the rear side to protrude frontward with respect to the fixed portion 10A.

<Adjustor 7>

The adjustor 7 may move the pair of supporting parts 4 in the widthwise direction in conjunction with each other. The adjustor 7 is, as shown in FIG. 6, arranged at a frontward position with respect to the fixed part 10A (see FIG. 3). The adjustor 7 includes, as shown in FIG. 4, rack gears 71, 72, a pinion gear 73, a supporting plate 74 (see FIG. 6), and a contractive spring 75 (see FIG. 6).

The rack gears 71, 72 face each other vertically. The rack gear 72 is arranged at an upper position with respect to the rack gear 71. The rack gears 71, 72 extend longitudinally in the widthwise direction. The rack gear 71, 72 have teeth at an upper end and a lower end thereof, respectively. The rack gear 71 is connected to the protrusive portion 41C in the supporting part 41 at a leftward end thereof. The rack gear 72 is connected to the protrusive portion 46C in the supporting part 46 at a rightward end thereof. As shown in FIG. 6, the rack gear 72 has a retainer 721, which protrudes upward, at an upper end thereof.

The pinion gear 73 is arranged, as shown in FIG. 4, at a position between the rack gears 71, 72. The pinon gear 73 is rotatably supported at a frontward area in the fixed part 10A (see FIG. 6), between the grooves 101, 102. Teeth of the pinion gear 73 mesh with the teeth in the rack gears 71, 72. The rack gears 71, 72 may move in the widthwise direction along with rotation of the pinion gear 73. Accordingly, the supporting parts 41, 46 may move along the grooves 101, 102 (see FIG. 6) in the widthwise direction. For example, when the supporting part 41 moves leftward for a certain distance, the supporting part 46 may move in conjunction with the supporting part 41 rightward for the same distance through the rack gear 71, the pinion gear 73, and the rack gear 72. In other words, the rack gears 71, 72 and the pinion gear 73 may move the pair of supporting parts 4 in directions to be farther apart from each other, i.e., outward along the widthwise direction. For another example, when the supporting part 41 moves rightward for a certain distance, the supporting part 46 may move in conjunction with the supporting part 41 leftward for the same distance through the rack gear 71, the pinion gear 73, and the rack gear 72. In other words, the rack gears 71, 72 and the pinion gear 73 may move the pair of supporting parts 4 in directions to be closer to each other, i.e., inward along the widthwise direction.

The supporting board 74 is, as shown in FIG. 6, fixed at a frontward position with respect to the pinion gear 73. The supporting board 74 includes an extended portion 740, which extends leftward. At a leftward end area in the extended portion 740, arranged is a retainer 741, which protrudes upward. The contractive spring 75 is hooked to the retainer 741 in the supporting board 74 and to the retainer 721 in the rack gear 72 so that the contractive spring 75 may apply an urging force, acting in a direction to pull the supporting parts 41, 46 closer, i.e., inward along the widthwise direction, to the supporting parts 41, 46.

<Locking Members 5, 6>

As shown in FIG. 4, the locking member 5 is arranged on the supporting part 41, and the locking member 6 is arranged on the supporting part 46. The locking members 5, 6 are symmetrical. In the following paragraphs, the locking member 5 may be described in detail while description of the locking member 6 may be omitted.

As shown in FIG. 5, the locking member 5 includes a first locking member 51 and a second locking member 52. The first locking member has a shape of a plate. The first locking member 51 includes a base portion 55, a contact portion 56, and a coupling portion 57. The base portion 55 has an approximate shape of a disk. A hole 55A is formed at a center of the base portion 55, and a screw 44 (see FIG. 5) is inserted in the hole 55A. As shown in FIG. 5, a first virtual line V1 extends through a supporting axis 44C at a center of a rod of the screw 44 inserted in the hole 55A. As shown in FIG. 7, the first virtual line V1 extends through a center of the base portion 55.

The contact portion 56 extends upward from an upper position in a frontward area in the base portion 55 with respect to a vertical center of the base portion 55. The contact portion 56 includes extended portions 561, 562, and a protrusive portion 563. The extended portion 561 extends upward from a position, at which the contact portion 56 is connected to the base portion 55. The extended portion 562 extends frontward from an upper end of the extended portion 561. The protrusive portion 563 extends upward from a frontward end of the extended portion 562. The extended portions 561, 562, and the protrusive portion 563 form a contact section 56A. In a view along the first virtual line V1, i.e., in a view along the widthwise direction, an upper-frontward end of the protrusive portion 563 and the first virtual line V1 are apart from each other for a first distance L1. In other words, the first distance L1 is a shortest distance between the end of the protrusive portion 563 and the first virtual line V1. When a downward force from above is applied to the protrusive portion 563, the extended portions 561, 562 may resiliently deform, and the protrusive portion 563 may move downward to some extent. When the protrusive portion 563 is released from the downward force, the extended portions 561, 562 may recover to the original forms, and the protrusive portion 563 may return to the original position.

The coupling portion 57 extends obliquely lower-frontward from a lower position with respect to the vertical center in the base portion 55. As shown in FIG. 5, the coupling portion 57 includes a protrusive portion 57A, which protrudes leftward, at a lower-frontward end of the coupling portion 57. The protrusive portion 57A has an approximate shape of a cylindrical rod. As shown in FIG. 7, a virtual line that extends through an axial center of the protrusive portion 57A intersects with the coupling portion 57 at an intersection point Pv. In a view along the first virtual line V1, i.e., in a view along the widthwise direction, the intersection point Pv and the first virtual line V1 in the first locking member 51 are apart from each other for a second distance L2. In other words, the second distance L2 is a shortest distance between the intersection point Pv and the first virtual line V1. The second distance L2 is shorter than the first distance L1 (L1>L2).

The second locking member 52 includes, as shown in FIG. 5, a base portion 58 and an engagement portion 59. The base portion 58 extends in a shape of a bar and inclines to be lower toward the rear and higher toward the front. The base portion 58 has a hole 58A at an upper position. The hole 58A is bored through the base portion 58 in the widthwise direction. The engagement portion 59 is arranged at a lower end of the base portion 58 and has teeth 59A at a lower end thereof.

As shown in FIG. 4, the locking member 6 includes a first locking member 61 and a second locking member 62, which are in configurations corresponding to the first locking member 51 and the second locking member 52, respectively, in the locking member 5. A base portion 65, a contact portion 66, and a coupling portion 67 (see FIG. 3) are in configurations corresponding to the base portion 55, the contact portion 56, and the coupling portion 57, respectively, in the first locking member 51. A base portion 68 (see FIG. 3) and an engagement portion 69 in the second locking member 62 are in configurations corresponding to the base portion 58 and the engagement portion 59, respectively, in the first locking member 51.

<Rotary Disks 43, 48>

As shown in FIG. 5, the rotary disk 43 has a shape of a disk. A plane disk surface of the rotary disk 43 spreads orthogonally to the widthwise direction. The rotary disk 43 is arranged rightward with respect to the base portion 55 in the first locking member 51. Between the rotary disk 43 and the base portion 41A in the supporting part 41, interposed is the base portion 55 in the first locking member 51. At a center of the rotary disk 43, formed is a hole 43A, through which a screw 44 is inserted. As shown in FIG. 2, the rotary disk 43 may contact a leftward end portion of the roll M and hold the roll M rotatably. As shown in FIG. 5, a diameter of the rotary disk 43 is substantially the same as a diameter of the base portion 55 in the first locking member 51.

As shown in FIG. 3, the rotary disk 48 has a shape of a disk. A plane disk surface of the rotary disk 48 spreads orthogonally to the widthwise direction. The rotary disk 48 is arranged leftward with respect to the base portion 65 in the first locking member 61. Between the rotary disk 48 and the base portion 46A in the supporting part 46, interposed is the base portion 65 in the first locking member 61. At a center of the rotary disk 48, formed is a hole, through which a screw 49 is inserted. As shown in FIG. 3, the rotary disk 48 may contact a rightward end portion of the roll M and hold the roll M rotatably. A diameter of the rotary disk 48 may be the same as a diameter of the base portion 65 in the first locking member 61.

<Assembling Procedure>

A procedure to assemble the supporting part 41, the locking member 5 including the first locking member 51 and the second locking member 52, and the rotary disk 43 together will be described below. Meanwhile, a procedure to assemble the supporting part 46, the locking member 6 including the first locking member 61 and the second locking member 62, and the rotary disk 48 together, which is substantially the same as the procedure to assemble the supporting part 41, the locking member 5, and the rotary disk 43 together, will be herein omitted.

As shown in FIG. 8, first, the base portion 58 in the first locking member 52 is inserted upward in the hole 411 formed in the extended portion 41B in the supporting part 41 from a lower side. The oblique inclination of the hole 411 coincides with an extending direction of the base portion 58 in the second locking member 52. The second locking member 52 is supported in the hole 411 movably with respect to the supporting part 41 along the inclination of the hole 411.

Next, the base portion 55 of the first locking member 51 is placed in proximity to a rightward face of the base portion 41A of the supporting part 41 (see FIG. 5). Meanwhile, an urging member 45 (see FIG. 5) is interposed between the base portion 41A of the supporting part 41 and the base portion 55 of the first locking member 51. The urging member 45 may be a compressive coil spring.

Next, the protrusive portion 57A of the coupling portion 57 in the first locking member 51 is inserted leftward in the hole 412, which is formed in the extended portion 41B of the supporting part 41, from the right. The protrusive portion 57A being inserted leftward in the hole 412 is inserted in the hole 58A (see FIG. 5) in the base portion 58 of the second locking member 52, which is arranged inside the extended portion 41B of the supporting part 41. Thus, the coupling portion 57 of the first locking member 51 is coupled with the second locking member 52.

Next, the rotary disk 43 is placed in proximity to a rightward face of the base portion 55 in the first locking member 51 (see FIG. 5). The base portion 55 is interposed between the base portion 41A of the supporting part 41 and the rotary disk 43 along the widthwise direction.

Next, the screw 44 is inserted leftward in the hole 43A (see FIG. 5) at the center of the rotary disk 43 from the right. The screw 44 in the hole 55A (see FIG. 5) penetrates the base portion 55 of the first locking member 51 to be screwed to the base portion 41A in the first supporting part 41. The first locking member 51 and the rotary disk 43 are supported by the rightward face of the supporting part 41 swingably and rotatably, respectively, about the supporting axis 44C, which coincides with the axis of the rod in the screw 44. In other words, the first locking member 51 and the rotary disk 43 are supported by the supporting part 41 swingably and rotatably, respectively, individually from each other. Meanwhile, the urging member 45 urges the first locking member 51 in a direction to swing clockwise in a view from the right (see FIG. 8). In the following paragraphs, unless otherwise noted, expression concerning rotating directions (e.g., clockwise or counterclockwise) will be based on the view from the right.

As the first locking member 51 swings, the coupling portion 57 swings likewise. In this regard, the second locking member 52, which is coupled with the first locking member 51 through the coupling portion 57, moves in conjunction with the swing movement of the first locking member 51 along a virtual motion line Vm (see FIG. 8), which extends in parallel with the fixed part 10A. The virtual motion line Vm coincides with the inclination of the hole 411 bored in the extended portion 41B of the supporting part 41 and with the extending direction of the base portion 58 of the second locking member 52. Meanwhile, as shown in FIG. 8, a second virtual line V2 extends orthogonally to the first virtual line V1, which extends along the supporting axis 44C (see FIG. 5), through the intersection point Pv, which is the intersection between the virtual line extending through the center of the protrusive portion 87A and the coupling portion 57. Therefore, the second locking member 52 may move in a direction substantially orthogonally to the second virtual line V2 in conjunction with the swing movement of the first locking member 51. In other words, the second virtual line V2 and the movable direction for the second locking member 52 are substantially orthogonal to each other.

<Cover Opening/Closing Movement>

FIG. 9A illustrates the locking member 5 when the cover 3 is at the open position. In FIGS. 9A-9B, illustration of the rotary disk 43 is omitted. Under the condition where the cover 3 is at the open position, the cover 3 is separated from the contact portion 56 of the first locking member 51. The first locking member 51 may swing clockwise due to the urging force of the urging member 45 (see FIG. 5). Along with the swing movement of the first locking member 51, the coupling portion 57 may move upper-frontward. Further, the second locking member 52 coupled with the coupling portion 57 may move upper-frontward, and the engagement portion 59 in the second locking member 52 may be separated upward from the engaging portion 53 in the fixed part 10B. Meanwhile, the teeth 59A (see FIG. 5) in the engagement portion 59 are unmeshed from the teeth (see FIG. 3) in the engaging portion 53. Therefore, the supporting part 41 may not be restrained from moving in the widthwise direction but may be movable in the widthwise direction. In the following paragraphs, the rotational position of the locking member 5 under the condition where the cover 3 is at the open position may be referred to as an unlocked position. The locking member 6, although detailed description thereof is omitted, should behave in the same manner as the locking member 5.

A user may, for example, open the cover 3, and the cover 3 may be placed at the open position. When the cover 3 is at the open position, the locking member 5 in the supporting part 41 and the locking member 6 in the supporting part 46 are located at the unlocked positions. With the locking members 5, 6 being at the unlocked positions, the user may operate and move the supporting parts 41, 46 to separate apart from each other, i.e., outward along the widthwise direction, so that the user may set the roll M (see FIG. 3) at the position between the separated supporting parts 41, 46. When the user releases the supporting parts 41, 46, the supporting parts 41, 46 may move closer to each other, i.e., inward along the widthwise direction, due to the urging force of the contracting spring 75 in the adjustor 7 so that the distance between the rotary disks 43, 48 may be equal to the width of the roll M. The user may thereafter close the cover 3.

In a process where the cover 3 is moved from the open position to the closed position (see FIG. 9B), the contact section 56D in the contact portion 56 of the first locking member 51 may contact a part of the cover 3 in proximity to the platen holder 33, and the first locking member 51 may swing counterclockwise against the urging force from the urging member 45 (FIG. 4).

FIG. 9B illustrates the condition of the locking member 5 when the cover 3 is at the closed position. In conjunction with the counterclockwise swing movement of the first locking member 51, the coupling portion 57 in the first locking member 51 may move obliquely lower-rearward, and the second locking member 52 coupled with the coupled portion 57 may move obliquely lower-rearward likewise. The teeth 59A (see FIG. 5) in the engagement portion 59 of the second locking member 52 may mesh with the teeth (see FIG. 3) in the engaging portion 53. Thereby, the supporting part 41 may be restricted by the locking member 5 from moving in the widthwise direction. In the following paragraphs, the rotational position of the locking member 5 under the condition where the cover 3 is at the closed position may be referred to as a locked position. Thus, in the process where the cover 3 moves from the open position (see FIG. 9A) to the closed position (see FIG. 9B), the locking member 5 may shift from the unlocked position (see FIG. 9A) to the locked position (see FIG. 9B). The supporting part 46 and locking member 6, although detailed description of those is omitted, should behave in the same manner as the supporting part 41 and locking member 5, respectively.

While the supporting parts 41, 46 are restricted from moving in the widthwise direction, the rotary disks 43, 48 are maintained in contact with the widthwise ends of the roll M. Therefore, the roll M may be supported at the widthwise sides by the supporting parts 41, 46 rotatably so that the thermosensitive label may be unrolled from the roll M to allow image printing thereon.

Benefits by the First Embodiment

The printing apparatus 1 has the pair of supporting parts 4, i.e., the supporting parts 41, 46, which may support the roll M contained in the container compartment 24 at the widthwise sides. The supporting parts 41, 46 may move in the widthwise direction in conjunction with each other through the adjustor 7. Therefore, the printing apparatus 1 may move the supporting parts 41, 46 in the widthwise direction to fit to the width of the roll M so that any one of rolls M having different widths may be stably stored in the container compartment 24. Accordingly, when the tape is unrolled from the roll M and extended in the printing apparatus 1, the tape may be restrained from skewing with respect to the direction orthogonal to the widthwise direction.

The locking members 5, 6 may be shifted between the unlocked position (see FIG. 9A), in which the locking members 5, 6 allow the supporting parts 41, 46 to be movable, and the locked position (see FIG. 9B), in which the locking members 5, 6 restrict the supporting parts 41, 46 from moving, in conjunction with the opening/closing movement of the cover 3. When the cover 3 is at the open position, the locking members 5, 6 are located at the unlocked positions; therefore, the user may move the pair of supporting parts 4 to fit to the width of the roll M easily. When the cover 3 is moved from the open position to the closed position, the locking members 5, 6 are shifted from the unlocked positions to the locked positions. When the cover 3 is at the closed position, the locking members 5, 6 are maintained at the unlocked positions. Therefore, the user may manipulate the pair of supporting parts 4 to be restricted from moving as easily as by closing the cover 3. Thus, the printing apparatus 1 may shift between the mode, in which the pair of supporting parts 4 are restricted from moving, and the mode, in which the paired supporting parts 4 are released from the restriction, without a specific shifting operation. Further, the locking members 5, 6 may be shifted automatically from the unlocked positions to the locked positions by moving the cover 3 to the closed position. Therefore, an undesirable situation, such that the user may start printing while the locking members 5, 6 are left at the unlocked positions, may be prevented.

Furthermore, the locking members 5, 6 are restricted from moving from the locked positions to the unlocked positions while the cover 3 is at the closed position. For example, when the printing apparatus 1 falls off from a higher place, an impact of the fall may affect the roll M. In such an occasion, the locking members 5, 6 may restrict the paired supporting parts 4 from moving, and the roll M may be restrained from moving inside the container compartment 24.

The locking member 5 is equipped with the urging member 45, which may urge the locking member 5 in the direction from the locked position toward the unlocked position. With the urging member 45, the locking member 5 may shift from the locked position to the unlocked position automatically in the process where the cover 3 is being opened. When the locking member 5 is at the unlocked position, meanwhile, the engagement portion 59 in the second locking member 52 is separated from the engaging portion 53. The locking member 6 behaves in the same manner. Therefore, the user may release the pair of supporting parts 4 from the restriction to be movable as easily as by opening the cover 3 and may exchange the roll M in the container compartment 24 with another roll M.

The locking member 5 includes the first locking member 51 and the second locking member 52. The first locking member 51 has the contact portion 56, at which the locking member 51 contacts the cover 3. The second locking member 52 has the engagement portion 59 engageable with the engaging portion 53. Therefore, the printing apparatus 1 may manipulate the contact portion 56 in the first locking member 51 to contact the cover 3 in the process where the cover 3 is being moved to the closed position. When the first locking member 51 is moved by the cover 3 contacting the contact portion 56 to swing, the second locking member 52 may be moved to swing in conjunction with the swing movement of the first locking member 51 so that the engagement portion 59 may engage with the engaging portion 53. The locking member 6 should behave in the same manner. Thus, the mechanism to shift the locking member 5 from the unlocked position to the locked position in conjunction with the closing movement of the cover 3 may be efficiently provided by the first locking member 51 and the second locking member 52.

The contact portions 56, 66 in the first locking members 51, 61 may contact the cover 3 at the areas in proximity to the platen holder 33. Meanwhile, the cover 3 may be more rigid at the areas in proximity to the platen holder 33 than the other areas. In this regard, by manipulating the first locking members 51, 61 to contact the cover 3 at the areas which are relatively rigid, the locking members 5, 6 may be stably maintained at the locked positions.

The first distance L1, which is the shortest distance between the contact portion 56 in the first locking member 51 and the first virtual line V1, is longer than the second distance L2, which is the shortest distance between the coupling portion 57 in the first locking member 51 and the first virtual line V1. Therefore, a radius of rotation for the contact portion 56 (i.e., the first distance L1), which may swing in conjunction with the swing movement of the first locking member 51, is larger than a radius of rotation (i.e., the second distance L2) for the coupling portion 57. In this regard, the first locking member 51 may move the second locking member 52 through the coupling portion 57 by a force, which is greater than the pressure from the cover 3 contacting the contact portion 56. Therefore, the engagement portion 59 in the second locking member 52 may engage with the engaging portion 53 by the greater force, and the engagement portion 59 may be attached to the engaging portion 53 firmly. The first locking member 61 and the second locking member 62 in the supporting part 46 should behave in the same manner. Therefore, for example, when the printing apparatus 1 falls off from a higher place, an impact of the fall may affect the roll M, but the pair of supporting parts 4 may be restricted firmly by the locking members 5, 6 from moving.

The virtual motion line Vm extending along the movable direction of the second locking member 52, which may move in conjunction with the swing movement of the first locking member 51, is substantially orthogonal to the second virtual line V2, which extends orthogonally to the first virtual line V1 through the coupling portion 57. With this orthogonal interrelation, a moving amount for the coupling portion 57, when the first locking member 51 swings in conjunction with the cover 3 contacting the contact portion 56, may be maximized in the movable direction for the second locking member 52. Therefore, while the first locking member 51 may swing in conjunction with the cover 3 contacting the contact portion 56 for a smaller swinging amount, the second locking member 52 may be moved for a substantial amount to have the engagement portion 59 engaged with the engaging portion 53. The first locking member 61 and the second locking member 62 in the supporting part 46 should behave in the same manner.

The base portion 55 in the first locking member 51 is interposed between the base portion 41A in supporting part 41 and the rotary disk 43 at the widthwise sides and swingably supported by the screw 44. In this arrangement, the first locking member 51 which is swingable with respect to the supporting part 41 may be attached to the supporting part 41 easily. Further, while the first locking member 51 is arranged in the intermediate position between the supporting part 41 and the rotary disk 43, an amount of space to store the structure to support the roll M, e.g., the supporting part 41 and the first locking member 51, may be reduced. The arrangement of the first locking member 61, the supporting part 46, and the rotary disk 48 may be equally reducible and beneficial. Furthermore, a quantity of items required in the structure to support the roll M, e.g., the pair of supporting parts 4, the locking members 5, 6, and the rotary disks 43, 48, may be reduced.

In the contact section 56A in the locking member 5, when the downward pressure is applied to the protrusive portion 563, the extended portions 561, 562 may resiliently deform, and the protrusive portion 563 may move downward for a small extent. The contact section in the locking member 6 should behave in the same manner. In this behavior, while positions of the cover 3 to press the protrusive portion 563 may vary depending on, for example, assembling errors or allowances in the printing apparatus 1, the contact section 56A may resiliently absorb the errors or the allowances so that the amount for the contact section 56A to move downward may be equally maintained. Furthermore, when, for example, an external shock is caused to the cover 3 at the closed position, the contact section 56A may absorb or reduce the shock and restrain the shock from being transmitted to the locking member 5 through the contact portion 56. Therefore, the locking member 5 may be prevented from being damaged.

The engaging portions 53, 54 have the teeth extending in the front-rear direction, which coincides with the direction for the tape to be unrolled and extended from the roll M. Therefore, the tape unrolled from the roll M may be extended smoothly without being caught by the teeth or interfered with by the engaging portions 53, 54.

Second Embodiment

A printing apparatus 1 according to a second embodiment of the present disclosure will be described below with reference to FIGS. 10 and 11A-11B. The printing apparatus 1 may be different from the printing apparatus 1 in the first embodiment in that a third locking member 8 is adopted in place of the locking member 5. In FIG. 10, illustration of the rotary disk 43 (see FIGS. 11A-11B) is omitted. In the printing apparatus 1 in the second embodiment, the locking member 6 is replaced with a locking member, which is not shown but is symmetrically similar to the third locking member 8 replacing the locking member 5. In the following paragraphs, description of the locking member corresponding to the locking member 6 may be omitted.

As shown in FIG. 10, the third locking member 8 is arranged on a rightward face of the supporting part 41. The third locking member 8 may be a thin plate spreading orthogonally to the widthwise direction and having a curved shape. The third locking member 8 includes extended portions 81A, 81B, and a hole 810. The screw 44 (see FIG. 11A) is inserted in the hole 810. The extended portion 81A extends obliquely upper-frontward from an area containing the hole 810. A contact portion 82 is arranged at an upper-frontward end of the extended portion 81A. The extended portion 81B extends obliquely lower-frontward from the area containing the hole 810. An engagement portion 83 is arranged at a lower-frontward end of the extended portion 81B. The supporting part 41 in the second embodiment does not have the holes 411, 412 (see FIG. 5) in the extended portion 41B.

A procedure to assemble the supporting part 41, the third locking member 8, and the rotary disk 43 together will be described below. First, the third locking member 8 is placed in proximity to the rightward face of the base portion 41A of the supporting part 41. The urging member 45 (see FIG. 5) is interposed between the base portion 41A and the third locking member 8. Next, the rotary disk 43 (see FIGS. 11A-11B) is placed in proximity to a rightward face of the third locking member 8. The third locking member 8 is interposed between the base portion 41A of the supporting part 41 and the rotary disk 43 at the widthwise sides. Next, the screw 44 is inserted leftward in the hole at the center of the rotary disk 43 from the right. The screw 44 penetrates the third locking member 8 in the hole 810 to be screwed to the base portion 41A in the first supporting part 41. The third locking member 8 and the rotary disk 43 are supported by the rightward face of the supporting part 41 swingably and rotatably, respectively, about the supporting axis 44C, which coincides with the axis of the rod in the screw 44. In other words, the third locking member 8 and the rotary disk 43 are supported by the supporting part 41 swingably and rotatably, respectively, individually from each other. Meanwhile, the urging member 45 (see FIG. 5) urges the third locking member 8 in a direction to swing clockwise in the view from the right. As the third locking member 8 swings, the contact portion 82 and the engagement portion 83 swing as well.

FIG. 11A illustrates the third locking member 8 when the cover 3 is at the open position. Under the condition where the cover 3 is at the open position, the cover 3 is separated from the contact portion 82 in the third locking member 8. Therefore, the third locking member 8 may swing clockwise due to the urging force of the urging member 45 (see FIG. 5). Along with the swing movement of the third locking member 8, the engagement portion 83 may be separated upward from the engaging portion 53 in the fixed part 10B. Meanwhile, the teeth in the engagement portion 83 are unmeshed from the teeth (see FIG. 3) in the engaging portion 53. Therefore, the supporting part 41 may not be restrained from moving in the widthwise direction but may be movable in the widthwise direction. In this regard, the rotational position of the third locking member 8 under the condition where the cover 3 is at the open position is the unlocked position.

In a process where the cover 3 is moved from the open position to the closed position (see FIG. 11B), the cover 3 may contact the contact portion 82 in the third locking member 8. The third locking member 8 may swing counterclockwise against the urging force from the urging member 45. FIG. 11B illustrates the condition of the third locking member 8 when the cover 3 is at the closed position. In conjunction with the counterclockwise swing movement of the third locking member 8, the engagement portion 83 may move obliquely lower-rearward, and the engagement portion 83 may mesh with the teeth (see FIG. 3) in the engaging portion 53. Therefore, the supporting part 41 may be restricted by the third locking member 8 from moving in the widthwise direction. In this regard, the rotational position of the third locking member 8 under the condition where the cover 3 is at the closed position is the locked position. Thus, in a process where the cover 3 moves from the open position (see FIG. 11A) to the closed position (see FIG. 11B), the third locking member 8 may shift from the unlocked position (see FIG. 11A) to the locked position (see FIG. 11B). The third supporting member corresponding to the locking member 6 should behave in the same manner as the third locking member 8.

Benefits by the Second Embodiment

In the printing apparatus 1 according to the second embodiment, in the process where the cover 3 is being closed, the cover 3 may contact the third locking member 8 at the contact portion 82. In conjunction with the cover 3 contacting the contact portion 82, the engagement portion 83 may be engaged with the engaging portion 53. In this configuration, the third locking member 8 may shift from the unlocked position to the locked position in conjunction with the cover being closed more easily compared to the configuration in the first embodiment.

The third locking member 8 is interposed between the base portion 41A in the supporting part 41 and the rotary disk 43 at the widthwise side and is swingably supported by the screw 44. In this arrangement, the third locking member 8 which is swingable with respect to the supporting part 41 may be attached to the supporting part 41 easily. Further, while the third locking member 8 is arranged in the intermediate position between the supporting part 41 and the rotary disk 43, an amount of space to store the structure to support the roll M, e.g., the supporting part 41 and the third locking member 8, may be reduced.

More Examples

Although examples of carrying out the invention have been described, those skilled in the art will appreciate that there are numerous variations and permutations of the image forming apparatus that fall within the spirit and scope of the disclosure as set forth in the appended claims. It is to be understood that the subject matter defined in the appended claims is not necessarily limited to the specific features or act described above. Rather, the specific features and acts described above are disclosed as example forms of implementing the claims.

For example, both of the pair of supporting parts 4 may not necessarily be movable in the widthwise direction, but solely one of the pair of supporting parts 4 may be movable in the widthwise direction. That is, for example, while the supporting part 41 may be movable in the widthwise direction, the supporting part 46 may be fixed immovably to the container compartment 24. In this configuration, solely the one of the supporting parts 4 that is movable, e.g., the supporting part 41, may have the locking member 5, and the other one of the supporting parts 4 that is not movable, e.g., the supporting part 46, may not be equipped with the locking member 6. For another example, the engaging portions 53, 54 may be arranged on an inward face of the body 2.

For another example, the first locking member 51 may not necessarily be urged by the urging member 45 but may swing clockwise from the locked position to the unlocked position due to the effect of gravity by a weight thereof while the cover 3 moves from the closed position to the open position. In other words, the urging member 45 may be omitted.

For another example, the first locking members 51, 61 may be coupled with the cover 3 through, for example, a linking device. The linking device may swing the first locking members 51, 61 in conjunction with the cover 3 moving from the open position to the closed position. In this configuration, the contact portions 56, 66 may be omitted from the first locking members 51, 61, respectively. For another example, the third locking member 8 may be vertically movable, and the third locking member 8 may be coupled with the cover 3 through a linking device. The third locking member 8 may move vertically in conjunction with the cover 3 moving between the open position and the closed position. When the third locking member 8 moves upward in conjunction with the cover 3 being opened, the engagement portion 83 in the third locking member 8 may be separated from the engaging portion 53 vertically. On the other hand, when the third locking member 8 moves downward in conjunction with the cover 3 being closed, the engagement portion 83 may approach the engaging portion 53 to be engaged with the engaging portion 53. In this configuration, the contact portion 82 may be omitted from the third locking member 8.

For another example, the first distance L1, which is the shortest distance between the contact portion 56 in the first locking member 51 and the first virtual line V1, may be substantially equal to or shorter than the second distance L2, which is the shortest distance between the first locking member 51 and the coupling portion 57. For another example, the virtual motion line Vm extending along the movable direction of the second locking member 52, which may move in conjunction with the swing movement of the first locking member 51, may not necessarily be orthogonal to the second virtual line V2, which extends orthogonally to the first virtual line V1 through the coupling portion 57. For another example, the first locking member 51 or the third locking member 8 may not necessarily be arranged on the leftward face of the supporting part 41. In other words, the first locking member 51 or the third locking member 8 may not necessarily be interposed between the supporting part 41 and the rotary disk 43. For another example, the form of the contact section 56A in the contact portion 56 may not necessarily be limited to that illustrated above. For another example, the contact section 56A may be formed in a resiliently deformable material, such as rubber.

What is claimed is:

1. A printing apparatus, comprising:

a body including a container compartment, the container compartment being configured to store a roll, the roll including a rolled recording medium, the container compartment having an opening at one side along an orthogonal direction being orthogonal to a first direction, the first direction being a widthwise direction of the roll;

a cover configured to be closable to cover the opening of the container compartment and openable to uncover the opening of the container compartment;

a pair of supporting parts arranged in the container compartment and configured to support one side and the other side of the roll along the first direction, at least one of the pair of supporting parts being movable in the first direction; and a locking member arranged on a movable supporting part being one of the pair of supporting parts that is movable in the first direction, the locking member being movable between a locked position, in which the locking member restricts the movable supporting part from moving under a condition where the cover is closed, and an unlocked position, in which the locking member allows the movable supporting part to move under a condition where the cover is open; and an engaging portion arranged in the container compartment and configured to engage with the locking member being located at the locked position, wherein the locking member at the unlocked position under the condition where the cover is open is separated from the engaging portion; and wherein the locking member is configured to contact the cover and shift from the unlocked position to the locked position to be engaged with the engaging portion in a process where the cover being open is moved to be closed.

2. The printing apparatus according to claim 1, further comprising an urging member configured to urge the locking member in a direction from the locked position toward the unlocked position.

3. The printing apparatus according to claim 1, wherein the locking member comprises:

a first locking member swingably supported by a sideward face of the movable supporting part to swing about a supporting shaft, the first locking member including a contact portion, at which the locking member is configured to contact the cover; and a second locking member movably supported by the movable supporting part, the second locking member being configured to move in conjunction with a swing movement of the first locking member, the second locking member including an engagement portion engageable with the engaging portion.

4. The printing apparatus according to claim 3, wherein the first locking member includes a coupled portion coupled with the second locking member; and wherein a first distance being a shortest distance between a first virtual line extending along the supporting shaft and the contact portion is longer than a second distance being a shortest distance between the first virtual line and the coupled portion.

5. The printing apparatus according to claim 4, wherein a second virtual line extending orthogonally to the first virtual line through the coupling portion and a movable direction for the second locking member are orthogonal to each other.

6. The printing apparatus according to claim 3, further comprising:

a rotary disk configured to contact and hold a sideward end portion of the roll along the first direction, the rotary disk being rotatably supported by the sideward face of the movable supporting part to rotate about the supporting shaft;

wherein the first locking member is interposed between the movable supporting part on one side and the rotary disk on the other side along the first direction.

7. The printing apparatus according to claim 3, wherein the contact portion includes a resiliently deformable contact section.

8. The printing apparatus according to claim 1, wherein the locking member comprises a third locking member swingably supported by a sideward face of the movable supporting part to swing about a supporting shaft;

wherein the third locking member comprises a contact portion, the contact portion being configured to contact the cover, and an engagement portion engageable with the engaging portion.

9. The printing apparatus according to claim 8, further comprising:

a rotary disk configured to contact and hold a sideward end portion of the roll along the first direction, the rotary disk being rotatably supported by the sideward face of the movable supporting part to rotate about the supporting shaft;

wherein the third locking member is interposed between the movable supporting part on one side and the rotary disk on the other side along the first direction.

* * * * *